United States Patent [19]

Kakehi et al.

[11] Patent Number: 4,876,874

[45] Date of Patent: Oct. 31, 1989

[54] METHOD OF HOT ROLLING STEEL STRIP WITH DEFORMED SECTIONS

[75] Inventors: Nobuo Kakehi; Yuzuru Takahashi; Norio Higuchi; Yoshikazu Izumihara, all of Muroran; Hiromi Matsumoto; Yuji Uehori, both of Kitakyushu, all of Japan

[73] Assignee: Nippon Steel Corporation, Tokyo, Japan

[21] Appl. No.: 128,112

[22] PCT Filed: Mar. 12, 1987

[86] PCT No.: PCT/JP87/00158

§ 371 Date: Nov. 13, 1987

§ 102(e) Date: Nov. 13, 1987

[87] PCT Pub. No.: WO87/05543

PCT Pub. Date: Sep. 24, 1987

[30] Foreign Application Priority Data

Mar. 15, 1986 [JP] Japan ..... 61-57675
Mar. 15, 1986 [JP] Japan ..... 61-57676

[51] Int. Cl.[4] ..... B21B 1/08; B21B 1/22; B21B 27/02

[52] U.S. Cl. ..... 72/199; 72/234

[58] Field of Search ..... 29/118, 119, 121.6, 29/123, 125; 72/199, 234, 243, 247, 366

[56] References Cited

U.S. PATENT DOCUMENTS

| | | | |
|---|---|---|---|
| 4,672,830 | 6/1987 | Tsukamoto et al. | 72/199 X |
| 4,703,641 | 11/1987 | Yarita et al. | 72/247 |
| 4,730,475 | 3/1988 | Ginzburg | 72/234 |

FOREIGN PATENT DOCUMENTS

| | | | |
|---|---|---|---|
| 55-106601 | 8/1980 | Japan | 72/234 |
| 57-52504 | 3/1982 | Japan | 72/234 |
| 58-6708 | 1/1983 | Japan | 72/199 |
| 59-209409 | 11/1984 | Japan . | |
| 1034800 | 8/1983 | U.S.S.R. | 72/199 |
| 1119748 | 10/1984 | U.S.S.R. | 72/199 |

*Primary Examiner*—E. Michael Combs
*Attorney, Agent, or Firm*—Pollock, Vande Sande & Priddy

[57] ABSTRACT

A method of stably effecting a rolling of a steel strip with deformed section by use of a continuous hot strip mill, said method comprising the steps of:

providing an excess metal portion along each of opposite sides of a meterial to be rolled for simultaneously obtaining one or a plurality of deformed section portions; and providing, on a roll for effecting said rolling and at a position corresponding to each of the excess metal portions, a hold portion constituted by a tilted surface placed in a contact-and-rolling relation to each of said excess metal portions so that a self-aligning function occurs in a rolled material itself.

5 Claims, 3 Drawing Sheets

CONTOUR OF SECTION AT ENTRANCE SIDE $C_H = t_1 - t_2$ $H = \frac{t_1 + t_2}{2}$

ROLLING

CONTOUR OF SECTION AT EXIT SIDE $Ch = t'_1 - t'_2$ $h = \frac{t'_1 + t'_2}{2}$

METHOD OF HOT ROLLING STEEL STRIP WITH DEFORMED SECTIONS

TECHNICAL FIELD

This invention relates to rolling by use of a caliber roll provided in one or a plurality of stands of a continuous hot strip mill and particularly to a rolling method of stably producing a steel strip of deformed section which steel strip varies in thickness in the direction of width.

BACKGROUND ART

Hitherto, regarding a method of providing differences in thickness in the direction of width of a strip, gthere has been known a method of using rolls each provided thereon with a crown or another method of using a roll provided thereon with a groove-like caliber.

The former pertains to an operation of producing usual strips. According to this method, in a case of providing a large difference in thickness, rolls each having a large crown are used in preceding stages of rolling regarding a hot strip mill, and the size of each of the crowns is reduced in accordance with the successive reduction of thickness of a rolled material, thereby forming a crown on the strip without disturbing a contour of the strip. In the case of this method, a widthwise cross-sectional shape of a strip to be formed is limited to a shape of the crown.

In the latter method, a groove is formed in a roll so as to provide a local projection on a strip. For example, this type of method is disclosed in U.S. Pat. No. 3,488,988, Japanese Examined Patent Publication No. 34022/1977, Japanese Unexamined Patent Publication No. 88943/1980 and so forth. Since, in this method, a provision of the thickness difference is effected in a final stand, the shape of a strip will be degraded if a difference in thickness is large between a section defined prior to the rolling which is to be effected at the final stand and another section provided by the rolling in the final stand of the mill, with the result that a defective product will be caused or it will become impossible to effect the rolling at the final stand. Thus, in the method there is a limitation regarding the section which can be imparted to strips. This rolling method is effective when applied to the rolling of a steel strip of deformed section in which a variation in thickness is repeated widthwise with a relatively small pitch. However, in such a case where a pitch "P" showed in FIG. 1 is large and where a thickness of the whole of a steel strip (,i.e., both of a thickness $t_1$ of a thick portion and another thickness $t_2$ of a thin portion) is relatively small, that is, in a case where a steel strip of deformed section is of a thin strip shape, a shape of a resultant steel plate has been apt to be degraded with the result that a defective product or defective rolling has been apt to be caused. FIG. 5 illustrates an example of rolling for simultaneously obtaining a pair of deformed section steel strips each similar to that shown in FIG. 1 in which rolling a roll barrel of a rolling mill is effectively utilized to simultaneously provide two sets of deformed section in a steel strip. In the drawing the reference numerals 1 and 3 denote upper and lower working rolls for effecting the rolling to obtain the deformed section steel strip, respectively. Reference numeral 2 denotes a caliber provided on the upper roll 1, and reference numeral 4 denotes a material to be rolled.

The present applicant has already disclosed, in the specification of Japanese Patent Application No. 128880/1984 (Japanese Unexamined Patent Publication No. 9911/1986), a method of rolling by use of roll having caliber so as to produce a good steel strip of a deformed section having a large difference in thickness in the direction of the width thereof, in which method a continuous hot rolling mill having one or a plurality of stands is used. This rolling method of producing a deformed section strip is characterized in that the strip is rolled under the following rolling condition for each stand:

$$|Ch_E/h_E - Ch_D/h_D| \leqq 0.3$$

wherein $Ch_E$ is a thickness difference (mm) of a deformed section defined at the entrance side; $h_E$ is an average thickness (mm) thereof at the entrance side; $Ch_D$ is a thickness difference (mm) of another deformed section defined at the exit side; and $h_D$ is an average thickness (mm) thereof at the exit side.

The minimum conditions for producing by use of rolls, a deformed section steel strip widely varying in thickness were established in the specification of the above-mentioned Japanese Patent Application No. 128880/1984. However, there has been no effective measure for preventing a rolled steel strip from being biased widthwise when the strip is rolled, and a further improvement has therefore been desired.

That is, in the case of rolling a strip, a biasing has occurred regarding the position of the strip since there is no mechanism for retaining strips widthwise in place regarding the transverse position thereof. However, in a case of rolling a flat-rolled steel strip, a widthwise slight biasing substantially causes no problem unless the steel strip is in a disengaged relation with a roll barrel. A bias occurring in another case of rolling a steel strip of deformed section having a thickness difference in the direction of width causes a position for engagement with rolls of a next stand to be deviated from a predetermined correct position, with the result that a difference in rolling reduction ratio occurs in the direction of the width of the steel strip, with an elongation difference also occurring to cause an improper shape, so that in an extreme case it becomes impossible to effect the rolling due to the occurrence of defects such as bore or due to the occurrence of a phenomenon of chew up. FIG. 6 illustrates a main part of a strip and rolls at the time of occurrence of a biasing in this rolling process. In particular, when the strip is to be produced in a multiple-stage rolling manner, the influence of such biasing is more significant. In FIG. 6, a reference numeral 5 indicates the center of a convex portion of the roll, a reference numeral 6 indicating the center of a recessed portion of a rolled strip, a reference numeral 7 indicating the extent of the bias regarding a strip. A reference symbol A indicates an area of the strip at which the strip is subjected to excessive rolling reduction, and a reference symbol B indicates an area where the strip is subjected to insufficient rolling reduction. Thus, a difference in the rolling reduction occurs between the areas A and B, which causes a difference in the elongation in the longitudinal direction, resulting in local shape defects of a rolled product or, in an extreme case, making it impossible to effect rolling.

Accordingly, in the case of a multistage rolling of this type of deformed section steel strip it is essential for a steel strip to stably pass continuously the center of each of stands provided with caliber, under an optimal rolling schedule so that a desired contour of a rolled product may be obtained.

Certain conditions necessary for the rolling of steel strips having a wide range of difference in thickness were disclosed in the specification of the above-mentioned previously filed Japanese Patent Application No. 128880/1984, but these conditions alone are insufficient, and the establishment of further conditions has been desired.

That is, a shape, an influence of the thickness difference at the entrance side of a rolling stand, on the thickness difference at the exit side thereof, and influence of the depth of a caliber of a rolling stand on the thickness difference at the exit side have needed to be examined in detail. For example, when obtaining a predetermined thickness difference by rolling, it is necessary to examine whether or not the aimed thickness difference can be attained by a caliber-roll pass at one stand, or it is necessary to determine optimum values such as the number of necessary stands in the case of multi-stand rolling by use of rolls having caliber.

DISCLOSURE OF THE INVENTION

The present invention has been achieved under the circumstances described above, and a first object of the present invention is to provide a method of producing a steel strip of deformed section in which a strip is stably and optimally rolled by a caliber roll of each of multi-stage stands used to produce a steel strip of deformed section having a wide range of thickness difference in the direction of the width thereof, whereby such defects as described above in connection with the prior art are prevented from occurring regarding the contour of the deformed section steel strip.

To achieve the first object, the method of the present invention includes the steps of: providing an additional body portion at each side of a strip which is to be rolled into one or a plurality of steel strips of deformed section; and providing in a roll having a caliber a pair of hold portions each having a tilt face formed in connection with th caliber so that a self-aligning of the strip is obtained.

A second object of the present invention is to provide a method of producing a steel strip of deformed section having a large thickness difference in a widthwise direction which comprises the steps of: providing a formula capable of determining a limit of the thickness difference which can be provided in one stand with respect to both a shape and a heredity of the thickness difference; calculating both a number of stands necessary to effect rolling by use of caliber rolls and a depth of each caliber so that the aimed steel strip of deformed section is obtained with good results.

To attain this second object, the present invention provides a method for producing a deformed section steel strip having a wide range of thickness difference in the direction of width by using a continuous hot rolling mill, which includes the steps of determining the number of necessary stands of rolling each applying a rolling-operation for providing a thickness difference in a rolled strip in accordance with both, a degree of steepness concerning a thickness change occurring in the direction of width of the steel strip and a thickness difference in the steel strip, and effecting the rolling thereof by use of the rolling stands each having a roll of optimum caliber defined by the equation showed below.

The term, "a degree of steepness", showed above is used to evaluate a shape of steel strip and is a percentage ratio of a height of a corrugation occurring in the rolling of a steel strip to a pitch of the corrugation.

$$C_m = \frac{C_h - \bar{\eta} \cdot (1 - \gamma) \cdot C_H}{1 - \bar{\eta}}$$

$C_m$: Depth of caliber
$\bar{\eta}$: Crown ratio heredity coefficient
$C_h$: Exit side thickness difference in the direction of width
$\gamma$: Rolling reduction
$C_H$: Entrance side thickness difference in the direction of width where $$\bar{\eta} = \frac{1}{\pi} \cdot \tan^{-1}\{(a_1 - Inv)/a_2\} + a_3$$

$$v = \frac{h^{1.5} \cdot D^{0.5}}{b^2}$$

$a_1$, $a_2$, $a_3$: Constants
$v$: Geometrical factor
h: Exit side average thickness
D: Roll diameter
b: Strip width The method to attain the second object of the present invention will be described in detail hereinbelow.

(1) The degree of steepness ($\lambda$) in a case of a deformed section steel strip (illustrated in FIG. 7) obtained in accordance with the present invention is generally represented by $$\Delta\epsilon = \xi\left(\frac{C_h}{h} - \frac{C_H}{H}\right)$$

, wherein $$\Delta\epsilon = \left(\frac{\pi}{2} \cdot \lambda\right)^2$$

in which $\Delta\epsilon$: elongation difference in the direction of width
$\xi$: shape-change coefficient
$C_h$: Exit side thickness difference in the direction of width
h: Exit side average thickness
$C_H$: Entrance side thickness difference in the direction of width
H: Entrance side thickness difference in the direction of width
H: Entrance side average thickness ($C_h$, h, $C_H$ and H are illustrated in FIGS. 8*a* and 8*b*)
$\lambda$: Degree of steepness. Thus, $$\lambda = \frac{2}{\pi}\sqrt{\xi\left(\frac{C_h}{h} - \frac{C_H}{H}\right)} \quad (1)$$

In order to meet a standard of a product at the stage of the final stand and in order to effect the rolling without any trouble at the stages of stands other than the final stand, $\lambda$ is necessary to be in a range of an allowable degree of steepness $\lambda c$.

In Equation (1), in the case of a deformed section steel strip, the symbols $C_h$ and $C_H$ are thickness difference in the direction of width, while in a case of a conventional flat plate the symbols $C_h$ and $C_H$ are values of strip crowns.

When judging whether or not a desired deformed section steel strip can be obtained by use of a single caliber roll, it is necessary to calculate the following factors:

$$\xi = \frac{1}{\pi} \cdot \tan^{-1}\{(k_1 - In\nu)/k_2\} + k_3; \text{ and}$$

$$\nu = \frac{h^{1.5} \cdot D^{0.5}}{b^2}$$

wherein $\upsilon$: Geometrical factor, h: Exit side average thickness,

D: Roll diameter, b: Width of plate, and $k_1$, $k_2$, $k_3$: Constants.

Then, a comparison described hereinbelow is made between $\lambda$ and the allowable degree of steepness $\lambda c$ defined at the final stand, that is, $$\lambda = \frac{2}{\pi} \cdot \sqrt{\xi\left(\frac{C_h}{h} - \frac{C_H}{H}\right)} \gtreqless \lambda_c \quad (2)$$

In a region of $\lambda \leqq \lambda_c$, it is possible to effect caliber rolling of a single stand. In a region of $\lambda > \lambda_c$, caliber rolling by use of plural-stands becomes needed.

FIG. 9 shows these regions. The smaller the exit side thickness difference $C_h$ in the direction of width or the smaller the width (b) of the strip or the larger the exist side average thickness (h), the narrower an impossibility region in which rolling by use of one-stand caliber roll is impossible. Judgment is thereby made as to whether or not one-stand caliber rolling is possible in accordance with the shape of section of a strip, (2) For a product having a cross-sectional shape which is judged to need multiple-stand caliber rolling, the thickness differences defined at the exit and entrance sides of each stand are determined from the following equation by commencing from the final stand and continuing toward an upstream side stand: wherein there is used a stand having the following relation as a caliber rolling-commencing stand, whereby $$\lambda i = \sqrt{\xi i\left(\frac{C_{hi}}{hi} - \frac{C_{Hi}}{Hi}\right)} \leqq \lambda_{ci} \quad 3$$

a number of stands necessary to effect the rolling is determined:

$$\lambda i = \sqrt{\xi i \cdot \frac{C_{hi}}{hi}} < \lambda_{ci}.$$

(3) In relation to $C_{hi}$ and $C_{Hi}$ determined in the preceding paragraphs, there is a well-known following equation of the exit side thickness difference:

$$C_{hi} = \xi \cdot C_m + \eta \cdot C_{Hi}$$

wherein $\xi$: Transfer ratio $C_m$: Depth of caliber $\eta$: Crown heredity coefficient, which factors have the following relations:

$$\xi = 1 - \bar{\eta}$$

$$\bar{\eta} = \eta[1 - \gamma]$$

wherein $\bar{\eta}$: Crown ratio heredity coefficient $\gamma$: Rolling reduction, which factors have in turn the following relation; thereby obtaining and $\xi$ and $\eta$. Then, the depth of caliber $C_m$ is determined from an equation:

$$\bar{\eta} = \frac{1}{\pi} \cdot \tan^{-1}\{(a_1 - In\nu)/a_2\} + a_3$$

$$C_m = \frac{C_h - \eta \cdot C_H}{\xi}$$

The crown heredity coefficient $\eta$ used herein represents the rate of heredity of an entrance side strip crown, which is determined on the basis of the fact that the exit side thickness difference (the strip crown of a strip at the exit side) $C_h$ in the direction of width is created by both a partial heredity of the entrance thickness difference $C_H$ and a partial transfer of the roll-caliber depth $C_m$.

The above steps (1), (2) and (3) are in turn effected to determine the optimum number of caliber rolling stands, and the optimum caliber depth at each stand, so that a shape meeting a desired degree of steepness may be obtained with respect to a desired cross-sectional shape (average thickness, width and thickness difference).

A deformed section steel strip is rolled through a hot strip mill by use of both the determined number of stands and the rolls for rolling determined in the manner described above.

BRIEF DESCRIPTION OF DRAWINGS

FIGS. 1 to 6 are illustrations of a method in accordance with the present invention which method will attain the first object of the present invention, wherein FIG. 1 is a cross-sectional view of a deformed section steel strip which is as a whole in the form of a thin steel strip;

FIG. 2 is an illustration of a method which represents an embodiment of thepresent invention;

FIG. 3 is an illustration of a manner of simultaneously obtaining deformed section steel strips from a rolled strip in which a plurality of deformed section portions are formed simultaneously as showed in FIG. 2;

FIG. 4 is an illustration of another embodiment;

FIG. 5 is an illustration of a state of rolling effected in a conventional manner; and FIG. 6 is an illustration of the phenomenon of biasing of a steep strip.

FIGS. 7 8*a*, 8*b* and 9 are drawings for illustrating a method in accordance with the present invention which will attain the second object of the present invention, wherein FIG. 7 is a cross-sectional view of an example of a deformed section steel strip; FIGS. 8*a* and 8*b* are illustrations of factors defining the shape of the deformed section steel strip; and FIG. 9 is a graph showing a region in which the production of a deformed section steel strip by use of one stand having a caliber roll becomes impossible.

BEST MODE FOR CARRYING OUT THE INVENTION

The present invention will be described below in detail with reference to the accompanying drawings.

A method illustrated in FIGS. 1 to 6 which will attain the first object of the present invention will be first described.

Figure 2:
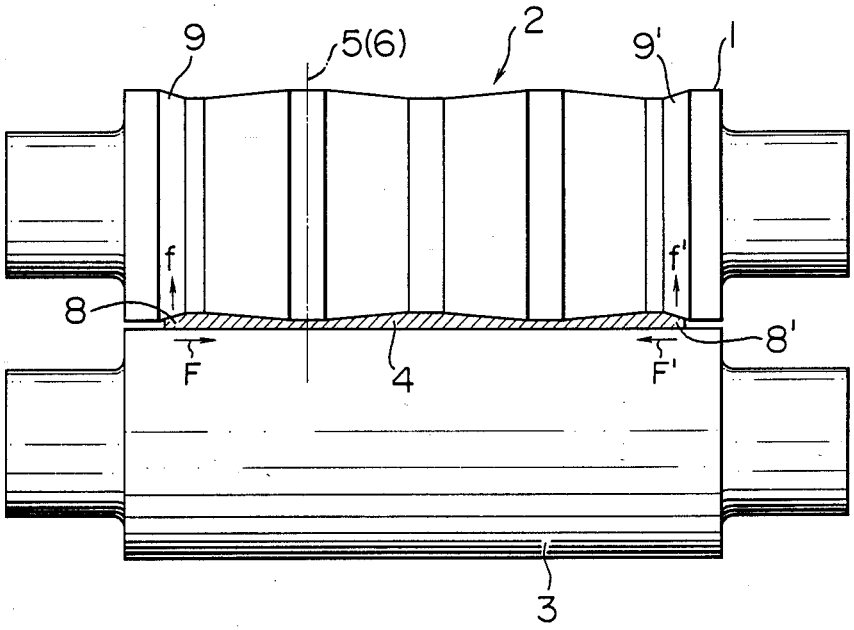

Generally, the rolling for producing a deformed section steel strip is effected in such a manner that a plurality of deformed section steel strips are simultaneously produced. FIG. 2 illustrates a case where two deformed section steel strips are obtained at the same time.

In FIG. 2, reference numerals 8 and 8' denote excess metal portions formed in a rolled material, and reference numerals 9 and 9' denote hold portions of roll calibers. Since the rolling surfaces of the hold portions corresponding to the excess metal portions 8 and 8' which are in contact with the hold portions 9 and 9 at the time of rolling are slanted, the rolled material 4 receives from the roll at its both edges thereof reaction forces F and F' directed to the center of the rolled material 4. In a case where the rolled material 4 is biased in a direction, for example, to the right as viewed in FIG. 2, the excess metal portion 8' excessively occupies the hold portion 9' at the side toward which the rolled material is biased, but the engagement of the excess metal portion 8 becomes insufficient with respect to the opposite hold portion 9. Also the width of a portion rolled by the hold portion 9' at the side toward which the rolled material is biased is increased, while the width at the opposite side is reduced. Therefore, the rolling reaction forces f and f' occurring at the hold portions and the reactions forces F and F' applied to the rolled material toward the center thereof are unbalanced, and the force is increased at the side toward which the rolled material is biased.

This matter means that an outwardly biased edge 8 or 8' of the rolled material 4 is prevented from further being biased toward the outside, that is, a self-aligning function occurs.

Next, a conception regarding the angle of inclination of the hold portions 9 and 9' will be described. If this inclination angle is not more than a tilt angle provided regarding the section of the rolled material 4, the hold portions will become insufficient with respect to the self-aligning function. Also, in a case where the excess metal portion is not to be used as a part of a product, it is preferable to make a size of the excess metal portion smaller to increase a yield of a product, that is, it is preferable to make the width of the excess metal portion smaller and to make the inclination of the hold portion larger.

On the other hand, with respect to such another viewpoint that a steel strip must be rolled as readily as possible without any trouble, it is preferable to reduce the value of the inclination angle of the hold portion to as small as possible. That is, the steeper the inclination, the larger a variation in the reduction of area regarding the engaging portion of the excess metal, with the result that a large elongation difference degrades the contour of a resultant steel strip product very much. If an extreme biasing of the steel strip occurs, there will occur such a case where an excess metal portion does not engage with the hold portion of the roll.

In taking these matters into consideration, the angle of the hold portion is set to be not less than 1° or not less than an angle of inclination of the cross-sectional shape of the rolled material.

The relation between a width of the hold portion and a size of the excess metal portion is determined so that the former and the latter are made to equal to each other or so that the width of the excess metal portion is set to be slightly narrower than the width of the hold portion 9. This is necessary for preventing apart of the excess metal portion from being projected beyond the hold portion and for preventing this part from being rolled in a narrow roll gap defined by flat roll portions. Unless this condition is met, a local elongation occurs at the edge portion, unappropriate edge wave will occur.

However, if the width of the hold portion provided in a caliber roll is extremely small in comparison with the size of the excess metal portion, the excess metal portion will not sufficiently occupy a caliber portion, so that the reaction forces F and F' directed toward the center of the rolled material at the time of rolling are reduced. That is, the self-aligning function is reduced.

It is therefore desirable to set the size of the excess metal equal to or slightly smaller than that of the hold portion and, at the same time, make the left and right portions symmetrical so as to balance the left and right reaction forces F and F'.

Figure 3:
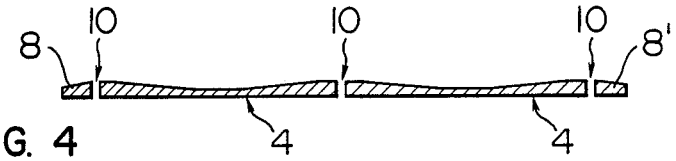

As described above, the present invention provides the hold portions 9, 9' each comprising a tilted surface in a roll for rolling a deformed section steel strip, thereby enabling a self-aligning function brought about by a rolled material itself so as to substantially prevent any biasing of the strip and enabling a stable roll pass of the strip. This is particularly effective in a case where a steel material, which is to be continuously rolled into a deformed section steel strip by a plurality of stands of caliber rolls, is made to stably pass the caliber roll stands at a high speed. FIG. 3 shows the cutting of a deformed section steel strip provided with two deformed sections showed in FIG. 2, and a reference numeral 10 denotes portions cut out by a slitter or the like.

It is preferable to form a mark for indicating the cutting positions by providing linear grooves or very thin projections on the rolled material by use of a roll having grooves or projections, thereby facilitating the cutting-out effected by a slitter or the like.

Figure 1:
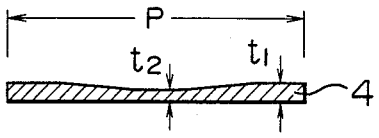
Figure 4:
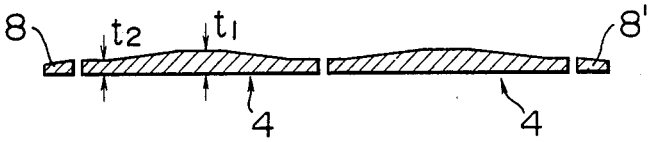
Figure 7:
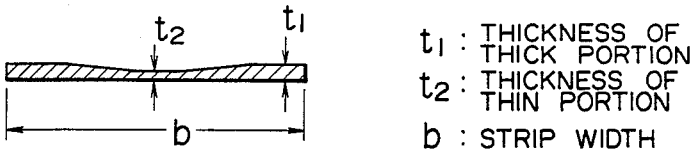
Figure 8A:
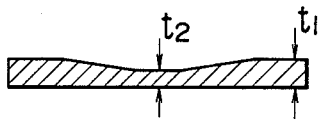
Figure 8B:
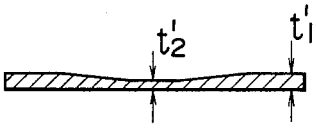
Figure 9:
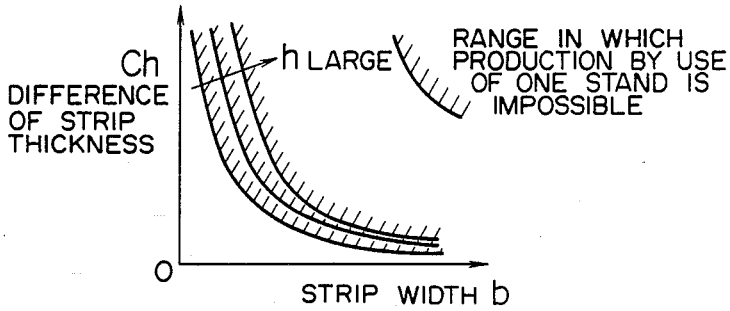
Figure 5:
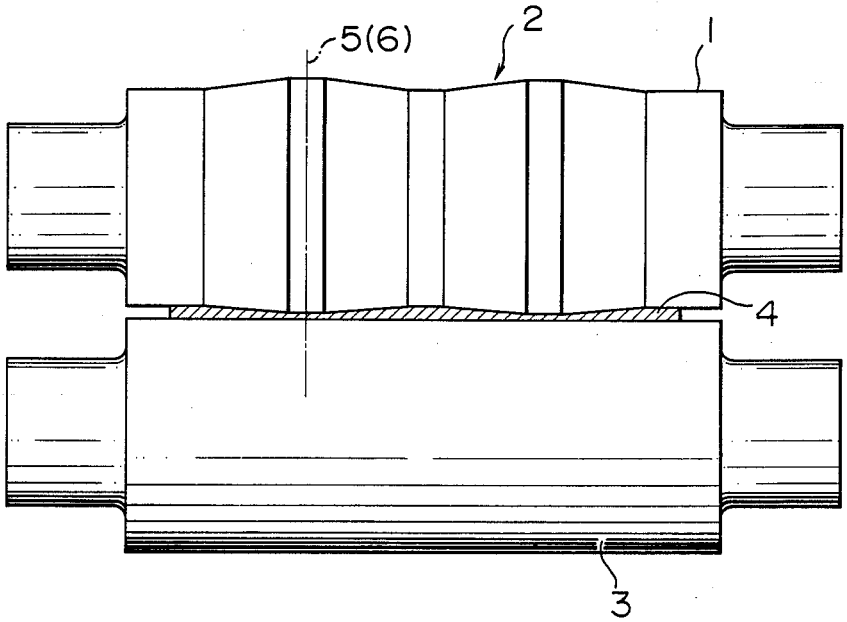
Figure 6:
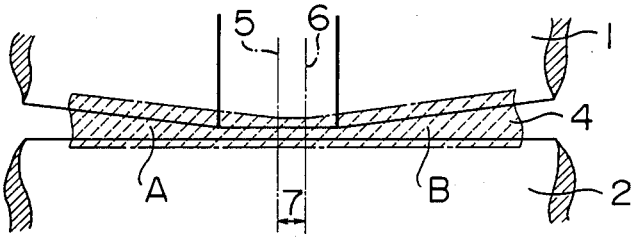

The present invention can be applied to any cross-sectional shapes other than that showed in FIG. 1, for example, a section showed in FIG. 4 which is thin at its both sides and is thick at its center or other sections similar thereto.

First Embodiment

Five stands each comprising an upper roll provided with a caliber were placed in a finishing stand apparatus of a continuous hot rolling mill, by use of which mill there were effected the rolling for obtaining a deformed section steel strip having such a finish shape that a width thereof (i.e. a pitch "P") is 200 mm, a thickness $t_1$ being 3,0 mm and another thickness $t_2$ being 2,0 mm, as showed in FIG. 1. The width of the roll hold portion was in a range of 35 to 50 mm and the angle thereof was in a range of 1.5 to 5.5 degrees.

To utilize a roll barrel at its maximum, a steel material was rolled to have a form in which there are provided three deformed section portions to be slit into three strips. Therefore, the width of a product strip was 600 mm, and an excess metal portions of 30 mm in width were provided at each of the edges thereof when the material was rolled, with the result that a deformed section steel strip having a good, desired shape was produced.

The rolling speed was the same value as that in the case of usual flat plate, and the rolling could be effected at a high speed.

Next, a second embodiment of the invention which attains the second object of the present invention will be described below.

Second Embodiment

A deformed section steel strip having a width of 200 mm, average thickness of 2.6 mm, thickness difference of 0.8 mm and a degree of steepness not more than 2.5% was produced by rolling through a hot strip mill having six finishing stands which were prepared as described below.

(1) If a rolling using one-stand caliber roll is intended at the final stand, a degree of steepness will become higher than 20% which is not only deviated from a desired degree of steepness but also makes the rolling itself impossible.

(2) Calculations were performed so that a degree of steepness defined at the final stand may be not more than 2.5% and so that a degree of steepness defined at each of other stands may be not more than 5%. As a result, caliber rolling using five stands was found to be necessary.

(3) Table 1 shows the results of calculations in which the caliber depth of each of the five stands was determined.

TABLE 1

| Stand number | 1 | 2 | 3 | 4 | 5 |
|---|---|---|---|---|---|
| Material thickness at exit side (mm) | 16 | 8.8 | 5.4 | 3.5 | 2.6 |
| Roll diameter (mm) | 600 | 680 | 640 | 520 | 500 |
| Thickness difference at exit side (mm) | 2.3 | 2.1 | 1.6 | 1.0 | 0.8 |
| Caliber depth (mm) | 2.9 | 2.5 | 1.9 | 1.2 | 0.87 |
| Degree of steepness (%) | 3.7 | 4.6 | 4.0 | 3.9 | 1.0 |

According to these calculation results, there were provided rolls each having the same roll-hold-portion as in the first embodiment and there was provided an excess metal portion of 30 mm in width along each of the edges of a material to be rolled. Then, a rolling was effected so that three deformed section portions each having a width of 200 mm may be formed, with the result that deformed-section steel strip each having a good shape were obtained.

Industrial Applicability

In the conventional rolling of producing various kinds of deformed section steel strip by use of a continuous hot rolling mill, there has been possible a caliber rolling effected by use of only one stand. However, in the present invention, it becomes possible to effect a rolling for obtaining the deformed section steel strip by use of a plurality of stands each provided with caliber, with the result that it becomes possible to mass-produce a steel strip having a thickness difference formed in a wide pitch. Thus, the present invention is significant in an industrial point of view.

Further, according to the present invention, optimal caliber rolling of a plurality of stands becomes possible by use of a hot strip mill, so that a mass production of a steel strip having an arbitrary thickness difference becomes possible.

What is claimed is:

1. A method of rolling a steel strip with deformed sections having a thickness change in the direction of the width of the steep strip, by use of a continuous, hot strip mill, said method comprising the steps of:
   - providing an excess metal portoion along each lateral side edge of a steel strip material to be rolled for simultaneously obtaining one or a plurality of deformed section portions;
   - providing, on a roll for effecting said rolling, a pair of holding portions, each portion being located at the opposite end of said roll;
   - positioning one of the excess metal portions at a position corresponding to one of said holding portions, each of said holding portions being constituted by a tilted surface placed in a contact-and-rolling relation to the excess metal portion, said tilted surfaces being oriented, such as to exert onto the steel material being rolled a force directed towards the center of the steel material; and,
   - rolling said deformed section steel strip in a plurality of reducing stages so that said forces exerted by said tiled surfaces effect a self-alignment of said strip during said rolling stages.

2. A method according to claim 1, wherein said tilted surfaces are each inclined downwardly and inwardly towards the center of the steel strip being rolled.

3. A method of stably effecting a rolling of a steel strip with deformed section by use of a continuous hot strip mill, said method comprising the steps of:
   - providing an excess metal portion along at least one lateral side edge of a steel strip to be rolled for obtaining at least one deformed section portion;
   - providing, on a roll for effecting said rolling and at a position corresponding to said excess metal portion, a holding portion constituted by at least one tilted surface placed in a contact-and-rolling relation to said excess metal portion, said tilted surface being oriented such as to exert onto the steel strip a force directed towards the center of the steel strip; and
   - rolling said deformed section steel strip in a plurality of reducing stages so that said forces exerted by said tilted surfaces effect a self-alignment of said strip during said rolling stages.

4. A method according to claim 3, wherein said tilted surface is inclined downwardly and inwardly towards the center of the steel strip being rolled.

5. A method of stably effecting a rolling of a steel strip with a deformed section having a thickness change in the direction of the width of the steel strip, by use of a continuous hot strip mill, said method comprising the steps of:
   - providing an excess metal portion along each lateral side edge of a steel material to be rolled for simultaneously obtaining at least one of deformed section portions; and
   - providing, on a roll for effecting said rolling, and at a position corresponding to each of the excess metal portions, a pair of holding portions, each constituted by a tilted surface placed in a contact-and-rolling relation to each of said excess metal portion, said tilted surfaces being oriented to exert onto the steel material being rolled a force directed towards the center of the steel material being rolled, determining a number of stands of rolls necessary for providing a thickness difference in the rolled strip of steel material in accordance with both, a degree of steepness defining a thickness change occurring in the direction of the width of the steel strip, and a strip-thickness difference;

providing an optimal caliber on a roll of each of the determined stands in accordance with a formula defined by:

$$C_m = \frac{C_h - \overline{\eta} \cdot (1 - \gamma) \cdot C_H}{1 - \overline{\eta}}$$

$C_m$: Depth of caliber $\overline{\eta}$: Crown ratio heredity coefficient $C_h$: Exit side thickness difference in the direction of width of steel material being rolled $\gamma$: Rolling reduction $C_H$: Entrance side thickness difference in the direction of width of steel material being rolled where $$\overline{\eta} = \frac{1}{\pi} \cdot \tan^{-1} \{(a_1 - [\ln v] \log_e v / a_2\} + a_3$$

$$v = \frac{h^{1.5} \cdot D^{0.5}}{b^2}$$

$a_1$, $a_2$, $a_3$: Constants $v$: Geometrical factor h: Exit side average thickness of the steel strip D: Roll diameter b: Strip width of the steel strip to be rolled; and rolling said deformed section steel strip in a plurality of reducing stages so that said forces exerted by said tilted surfaces effect a self-alignment of said strip during said rolling stages.

* * * * *